US007650861B2

(12) United States Patent
Schafer et al.

(10) Patent No.: US 7,650,861 B2
(45) Date of Patent: Jan. 26, 2010

(54) CAMSHAFT ADJUSTER

(75) Inventors: Jens Schafer, Herzogenaurach (DE); Martin Steigerwald, Erlangen (DE); Jonathan Heywood, Pettstadt (DE)

(73) Assignee: Schaeffler KG, Herzogenaurach (DE)

( * ) Notice: Subject to any disclaimer, the term of this patent is extended or adjusted under 35 U.S.C. 154(b) by 343 days.

(21) Appl. No.: 11/574,435

(22) PCT Filed: Aug. 9, 2005

(86) PCT No.: PCT/EP2005/008612

§ 371 (c)(1),
(2), (4) Date: Feb. 28, 2007

(87) PCT Pub. No.: WO2006/024371

PCT Pub. Date: Mar. 9, 2006

(65) Prior Publication Data

US 2009/0050088 A1 Feb. 26, 2009

(30) Foreign Application Priority Data

Aug. 28, 2004 (DE) ..... 10 2004 041 751

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | |
|---|---|---|---|
| 3,978,829 | A | 9/1976 | Takahashi et al. |
| 5,876,287 | A | 3/1999 | Barickman |
| 5,992,361 | A | 11/1999 | Murata et al. |
| 6,422,188 | B2 | 7/2002 | Pierik |
| 2004/0187819 | A1 | 9/2004 | Takenaka et al. |

FOREIGN PATENT DOCUMENTS

| | | |
|---|---|---|
| DE | 4039494 | 9/1992 |
| DE | 19726300 | 1/1998 |
| DE | 10248351 | 4/2004 |
| WO | 9400676 | 1/1994 |

*Primary Examiner*—Ching Chang
(74) *Attorney, Agent, or Firm*—Volpe and Koenig, P.C.

(57) ABSTRACT

A camshaft adjuster for adjusting the relative angular positions of a camshaft and a crankshaft of an internal combustion engine in accordance with a setting shaft is provided. In which the setting shaft is driven by a setting assembly and has a driving connection with an adjusting gear through a coupling. The drive moment is transmitted in the coupling by a radial extension (21) of a first coupling half (19), which contacts a second coupling half (25) without play in a circumferential direction and which is movable in a direction of a Y-Y axis relative to a second coupling half (25). This permits compensation of eccentricities between the setting shaft of the setting assembly and the adjusting gear.

17 Claims, 5 Drawing Sheets

CAMSHAFT ADJUSTER

BACKGROUND

The invention relates to a camshaft adjuster for adjusting the relative angular position of a camshaft relative to a crankshaft of an internal combustion engine.

In DE 102 48 351 A1, a camshaft adjuster for adjusting the relative angular position of a camshaft relative to a crankshaft of an internal combustion engine is disclosed, in which the adjustment is made with a setting shaft, which is driven by a setting assembly. The setting shaft is in driving connection with an adjusting gear, here a speed-increasing triple-shaft gear mechanism constructed as a double planetary gear, by means of a backlash-free, detachable coupling. The use of a swashplate gear or another triple-shaft gear mechanism is also possible. Through the separate construction of the setting assembly on one side and the adjusting gear on the other side, the setting assembly can be completely preassembled and installed or exchanged based on the detachable coupling in a simple way. As possible couplings, feather key couplings, profiled shaft couplings, such as polygonal, toothed, wedge, and multiple-cornered couplings are noted. As means preventing possible backlash, biased metal or plastic springs, a polymer band, or a polymer O-ring can be used, which are to bridge play between individual coupling surfaces. Furthermore, despite the backlash-free coupling, it is ensured that the axial movement of one coupling half is enabled relative to the other coupling half, so that expansion of the components due to heat is not impaired. The coupling can be constructed as a claw coupling, which has intermeshing axial claws, wherein spacings are provided between the claws, which are bridged without backlash by teeth elements of an elastic, biased polymer collar. The claw coupling also allows the compensation of a small axial offset and also has a vibration-damping effect due to the elasticity of the polymer band. Furthermore, it is proposed that an inner or outer part of the coupling is formed from an elastic plastic. For economical production and for compact construction, it is also proposed that internal or external teeth formed of plastic with a metallic intermediate lining with a corresponding construction is vulcanized or injection-molded onto corresponding parts of the toothed shaft coupling and that the intermediate lining is connected to the toothed shaft coupling preferably by an interference fit.

SUMMARY

The invention is based on the objective of providing a camshaft adjuster, which guarantees good attachment of the adjusting gear to the setting shaft under consideration of costs and/or assembly aspects.

The objective is met by the features of the invention.

In the camshaft adjuster according to the invention, the drive moment is transmitted between the setting shaft and the adjusting gear (exclusively) by a radial extension of a first coupling half. The use of such a radial extension initially has the advantage that, in the extension, the drive moment for a lever arm increased relative to the radius of the setting shaft is transmitted. Here, smaller transmission forces become active, which, in addition to smaller loading of the participating components, results in reduced friction forces in the contact between the first coupling half and an associated second coupling half. Here, relative movements of the first coupling half relative to the second coupling half within a plane perpendicular to the contact force can be simplified, which can be used, for example, for compensating expansion due to heat.

Deviating from the state of the art, a claw coupling with several axial extensions in the form of claws is not used, but instead only a single radial extension is used. The extension contacts the second coupling half in the circumferential direction without backlash. The backlash-free realization of the contact between the first and second coupling halves has special advantages for a change in direction of the drive motion or the contact force between the first and second coupling halves occurring while the internal combustion engine is running. The backlash-free construction cannot produce an undesired change of the relative angular position between the first and second coupling halves, which would result in inaccuracies in terms of setting the desired relative angular position between the camshaft and crankshaft. In addition, shock-like loading due to backlash can be prevented.

Furthermore, the radial extension in the radial direction is movable relative to the second coupling half. This construction has the advantage that for eccentricity due to tolerances in the first coupling half relative to the second coupling half or the setting shaft relative to the adjusting gear, at least the components in the direction of the radial extension can be compensated by the degree of shifting freedom. For the case that at least one coupling half can be mounted in several angular positions relative to the associated components, a degree of shifting freedom in the radial direction is sufficient, because in this case the eccentricity can be set so that it can be compensated by a shift in the radial direction.

The degree of shifting freedom named above can include, for example, a sliding motion of the coupling halves relative to each other. Alternatively, it is possible that the degree of shifting freedom is set for bonding the coupling halves to each other by constructing the contact region or other regions of the coupling halves elastically, so that the shift corresponds to elastic deformation.

Through the degree of shifting freedom it is further guaranteed that a transverse force, which is dependent on the size of the eccentricity, is not exerted on the first and second coupling halves—as is the case for the state of the art named above. Instead, an installation can be performed for different eccentricities due to the degree of shifting freedom, without exerting (significant) transverse forces on the coupling halves.

Another improvement of the possibilities for compensating eccentricities is given when the extension can pivot relative to the second coupling half parallel to a longitudinal axis of the coupling half. In this case, according to the invention it is also possible to compensate eccentricities that do not (exclusively) have a component in the direction of the degree of shifting freedom. Such eccentricities can be compensated by superimposing a rotation and a shift in the direction of the degree of shifting freedom. For this configuration, transverse forces acting on the coupling halves and thus on any orientation, for example, of the adjusting gear and/or the setting assembly, can also be reduced.

Preferably, at least one contact surface between the extension and second coupling half has a crowned construction. Crowned contact surfaces have the advantage, on one hand, that improved and easier to model contact conditions are produced, because a Hertzian contact of similar contact surfaces is produced. On the other hand, through a crowned construction, in an especially simple way a degree of shifting freedom and the previously explained rotation about a longitudinal axis oriented parallel to a longitudinal axis of the coupling half can be guaranteed.

An especially simple production is realized when the extension is constructed separate from the setting shaft and connected to this shaft via a shaft-hub connection. In this case, the extension with the associated hub can be realized separate from the setting shaft. Furthermore, the known shaft-hub connections represent reliable and easy-to-produce connections between a drive shaft and a driven body, here the extension.

For a special camshaft adjuster, the shaft-hub connection includes an interference fit, which has been produced, for example, with a heat treatment, a non-positive-fit connection, such as adhesion or welding, or a positive-fit connection, for example, a feather key or splined shaft teeth, or attachment means, such as, for example, a screw connection between the extension and setting shaft.

In an especially material-saving, economical method, the extension is produced without cutting, for example, by means of sintering, extrusion, molding, or shaping of sheet metal. In this way, an extension corresponding to the mechanical requirements can be produced in an especially simple way, wherein, for example, a bent sheet-metal part is also advantageous in terms of the component weight.

An advantageous improvement of the invention is provided through constructing the extension separate from the setting shaft and inserting it into a recess of the setting shaft. Here, the recess can be formed in the setting shaft during the shaft production or at a later time through cutting work or forming a bore in this shaft, without making the actual production of the setting shaft more difficult. For the extension, any materials can be selected and any production methods can be used, even those deviating from those of the setting shaft. By inserting the extension into the recess, a positive-fit or friction-fit connection can be produced. Alternatively or additionally, non-positive-fit connections and/or attachment means are possible.

The transmission of the drive moment between the extension and the second coupling half is performed, for example, by an axial projection of the second coupling half, which contacts the radial extension for transmitting force in the circumferential direction. Alternatively, the invention proposes that the extension is housed without backlash in a radial recess of the second coupling half. Such a radial recess from the second coupling half can be produced in an especially simple way, wherein, under some circumstances, the axial length of the second coupling half relative to the embodiment with an axial projection can be reduced.

For a special camshaft adjuster according to the invention, the radial recess has an approximately Ω-shaped cross section in the second coupling half. Here, the second coupling half contacts the extension—essentially independent of any rotation—in the narrowest area of the Ω-shaped recess. The expansion of the Ω-shaped recess is used for permitting shifts and rotations of the extension relative to the second coupling half for an eccentric assembly.

Preferably, the recess is constructed as an axial groove of a second coupling half formed as a hollow shaft. Here, the second coupling half can directly represent a gear element of the adjusting gear. Such a recess can be produced in an especially simple way, wherein assembly can also be simplified by such a groove, because here only the first coupling half with the extension has to be inserted into the axial groove.

According to another embodiment of the camshaft adjuster according to the invention, the first coupling half with the extension can move axially relative to the second coupling half. Here, freedom of play can be provided over the entire axial shift or else only in a sub-area of the axial shift. Such a degree of axial shifting freedom is advantageous, on one hand, for assembly, because in the case that the position of the first and second coupling half has not yet been fixed, a connection between the extension and second coupling half can already be produced and to the same extent an axial shift between the first coupling half and second coupling half is still possible. For mounted coupling halves, the degree of axial shifting freedom has the advantage that the extension can be shifted relative to the second coupling half as a result of the expansion of the setting shaft or the setting assembly due to heat or as a result of other components of the camshaft adjuster, without introducing axial forces into the coupling halves, the adjusting gear, and/or the setting assembly, which would represent additional loads, in particular, for the bearing.

According to another aspect of the invention, forces flow between the extension and second coupling surface via an element that is elastic in the circumferential direction. Here, for the elastic element the elastic means noted in DE 102 48 351 A1, such as, for example, metal springs or a polymer band can be used. In this case, backlash-free contact of the radial extension on the second coupling half is understood to be backlash less than 0.6°, which is produced by the elastic element. In addition to elasticity in the circumferential direction, the elastic element can also provide an axial elastic bond. It is also possible that the extension itself or a pin forming the extension features inherent elasticity, so that this part can form the elastic element itself.

Preferably, an elastomer body, a thermoplastic, or a duroplastic is used as the elastic element, which is vulcanized onto a component of the coupling, such as the extension, the pin, and/or the second coupling half. Such a composite body represents an optimum component in terms of the production requirements and the mechanical properties.

The dynamic response of the camshaft adjuster is improved and the bearing requirements are reduced when the coupling half with the extension has a mass-balancing element. An unbalanced mass, which could be produced as a result of the extension, is compensated by the mass-balancing element. An unbalanced mass would create rotating inertial forces, which could lead to the stimulation of vibrations and increased loads on the bearing.

According to one embodiment of the invention, the first coupling half and thus the extension are locked in rotation with the setting shaft.

Advantageous improvements emerge from the dependent claims, the description, and the drawings.

BRIEF DESCRIPTION OF THE DRAWINGS

Additional features of the invention emerge from the following description and the associated drawings, in which embodiments of the invention are shown schematically. Shown are.

DETAILED DESCRIPTION OF THE PREFERRED EMBODIMENTS

Figure 1:
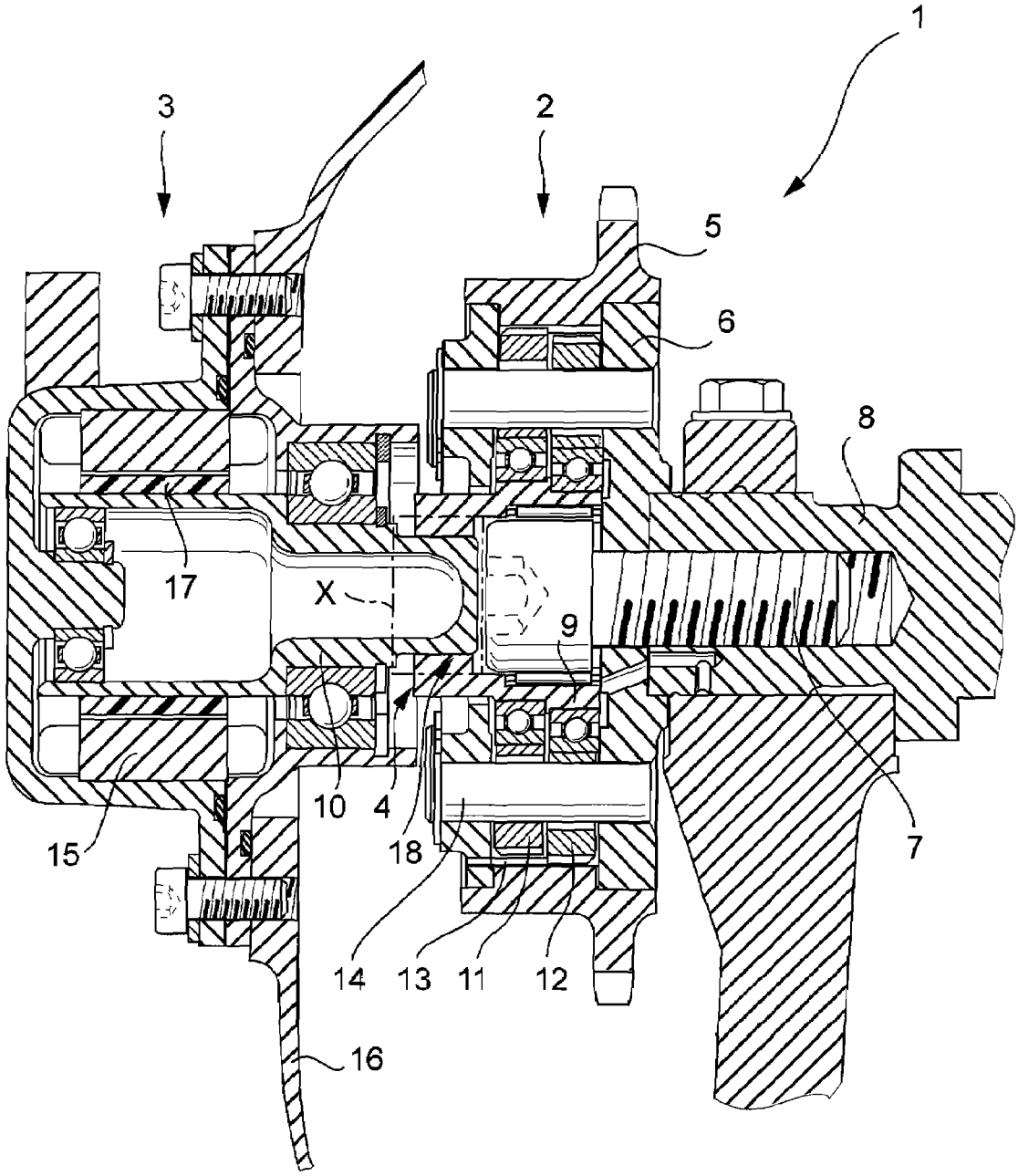
FIG. 1 a cross-sectional view of a camshaft adjuster with a setting shaft and an adjusting gear, which are connected to each other by a coupling (state of the art)

In FIG. 1, an electric camshaft adjuster 1 with an adjusting gear 2 and an electric setting assembly 3 is shown as an example, which are constructed as separate units and which can be connected detachably by a coupling 18.

The adjusting gear 2 is a triple-shaft gear mechanism, which features a high gear ratio (gear ratio range from 1:30 to 1:250) and high efficiency as an eccentric gear. The adjusting gear 2 has a drive shaft and a driven shaft and also an adjusting gear shaft 9. The drive shaft is constructed with a chain wheel 5 and is locked in rotation with a crankshaft (not shown) via a chain (similarly not shown). The driven shaft is constructed with a closing wall 6, which is locked in rotation with a camshaft 8 by a tensioning screw 7. The adjusting gear shaft 9 is constructed as an eccentric shaft, which, according to the embodiment shown in FIG. 1, is connected to a setting shaft 10 practically without backlash but movable in the axial direction via the coupling 18 constructed as a two-cornered shaft coupling 4. The adjusting gear shaft 9 is used for driving two spur gears 11, 12, which mesh with internal teeth 13 of the chain wheel 5 and transmit the adjusting moment via pins 14 and via the closing wall 6 to the camshaft 8. The electric setting assembly 3 has a stator 15, which is mounted on the cylinder head 16 and a permanent magnet rotor 17, which rotates with the setting shaft 10 (cf. also DE 102 48 351 A1 in terms of other details). Below, the longitudinal axis of the adjusting gear or the setting assembly is designated with the axis X-X. A direction transverse to the longitudinal axis is designated as the radial direction.

Deviating from the construction of the camshaft adjuster 1 shown in FIG. 1, any other known type of camshaft adjuster can also be used, in which a drive motion must be transmitted from a setting shaft 10 to an adjusting gear shaft 9 via a coupling 18, for example, a camshaft adjuster with a swash-plate gear.

Figure 2:
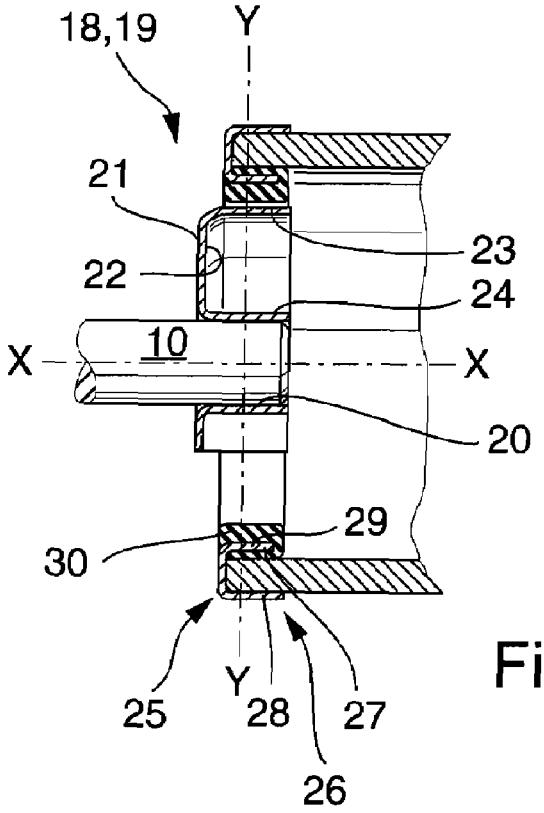
FIG. 2 a longitudinal cross-sectional view of a coupling with a first coupling half and a second coupling half.
Figure 3:
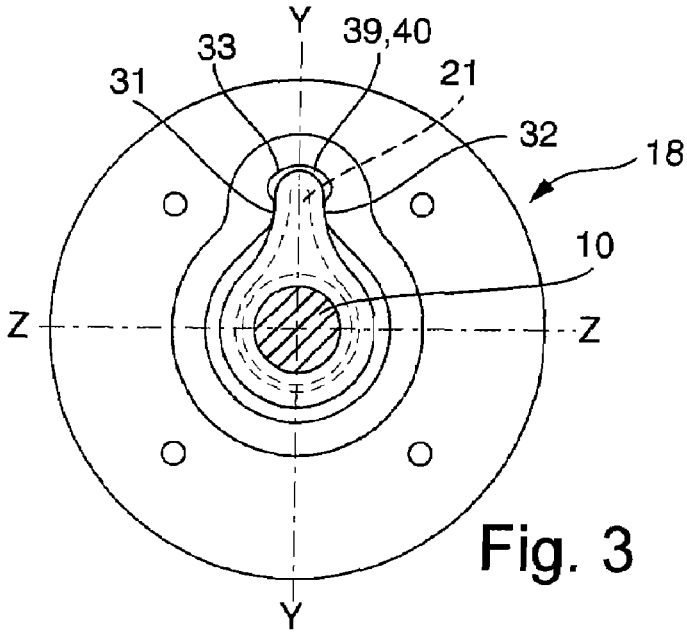
FIG. 3 a front view of the coupling according to FIG. 2.

According to FIGS. 2 and 3, a coupling 18 according to the invention is shown in longitudinal section and in a front view, respectively. A first coupling half 19 is locked in rotation with the setting shaft 10. For the embodiment shown in FIGS. 2 and 3, the first coupling half 19 is constructed as a bent sheet-metal part or as a die-formed part. The first coupling half 19 has a bore 20, in the region of which the first coupling half 19 is connected to the setting shaft 10. Furthermore, the first coupling half has a radial extension 21, which forms a kind of finger or a cam. The first coupling half 19 has a U-shape in each half longitudinal section with a base leg 22 and two side legs 23, 24, wherein the spacing of the side legs 23, 24 is a maximum in the region of the radial extension (12 o'clock position in FIG. 3) and decreases continuously in the circumferential direction towards the opposite side (6 o'clock position in FIG. 3). The side leg 24 limits the bore 20 radially on the inside.

The second coupling half 25 has a metal body 26, which is U-shaped in the half longitudinal section and which rotates about the axis X-X with changing distance and with different radial extents with a base leg 27 and two parallel side legs 28, 29. An elastic element 30 is attached on both sides to the radially inner side leg 29. In particular, an elastomer body is vulcanized onto this leg. The second coupling half 25 pinches a tubular end of the adjusting gear shaft 9 between the elastic element 30 and the radially outer side leg 28, so that the second coupling half 25 and the adjusting gear shaft 9 are locked in rotation with each other. In the radially outer end region of the radial extension 21, this extension contacts the elastic element 30 and thus the second coupling half 25 in the region of contact surfaces 31, 32 without play in both circumferential directions, especially under the biasing of the elastic element 30. Here, the second coupling half 25 has a radial recess 39 in the view shown in FIG. 3 with essentially Ω-shaped internal contours 33. In the narrowest region of the Ω-shaped internal contours 33, the contact surfaces 31, 32 are formed, while in the region of the extension of the Ω-shaped internal contours 33 between the second coupling half 25 and the radial extension 21, a gap 40 is formed both in the radial direction and also in the circumferential direction. In the region of the contact surfaces 31, 32 or the narrowest region of the Ω-shaped internal contours 33, the second coupling half 25 has a crowned or convex construction in the view shown in FIG. 3, while in the corresponding region the radial extension 21 has a flat or concave construction with a smaller curvature than the crowned regions of the second coupling half 25.

Figure 4:
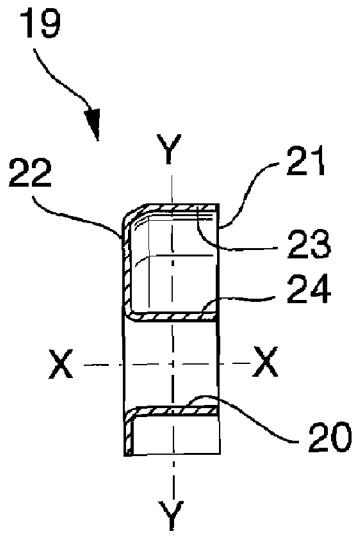
FIG. 4 a longitudinal cross-sectional view of a first coupling half of the coupling according to FIG. 2.
Figure 5:
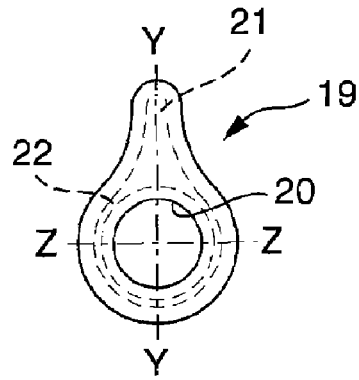
FIG. 5 a front view of the first coupling half according to FIG. 4.

FIGS. 4 and 5 show the first coupling half 19 formed separate from the setting shaft 10.

Figure 6:
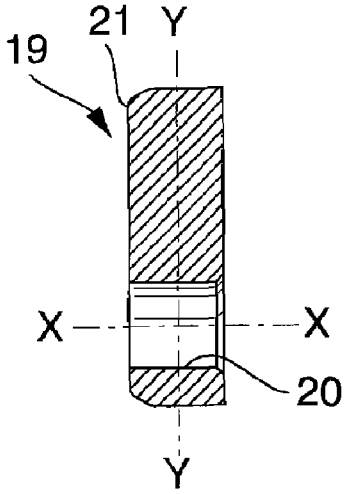
FIG. 6 a longitudinal cross-sectional view of another embodiment of the first coupling half according to the invention.
Figure 7:
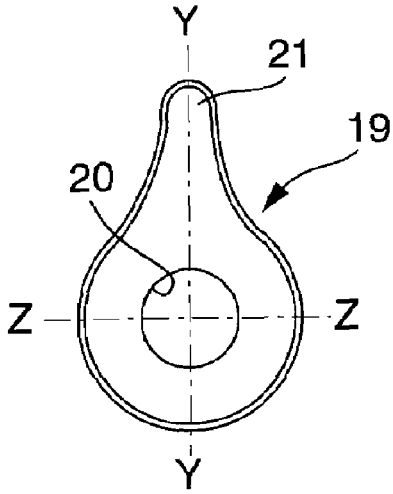
FIG. 7 a front view of the first coupling half according to FIG. 6.

FIGS. 6 and 7 show an alternative embodiment of the first coupling half 19, wherein this has the same outer contours but is not formed with a U-shaped half longitudinal section, but instead from a solid material.

Figure 8:
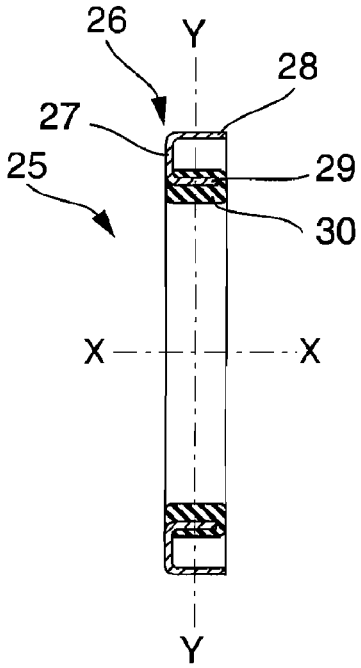
FIG. 8 a longitudinal cross-sectional view of the second coupling half of the coupling according to FIG. 2.
Figure 9:
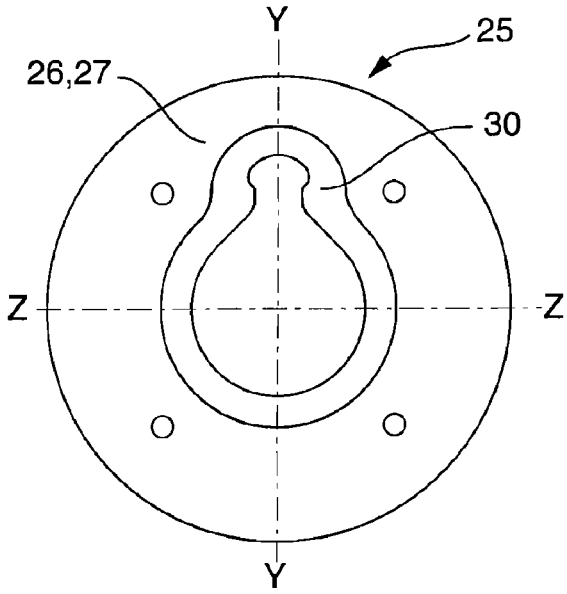
FIG. 9 a front view of the second coupling half according to FIG. 8.
Figure 10:
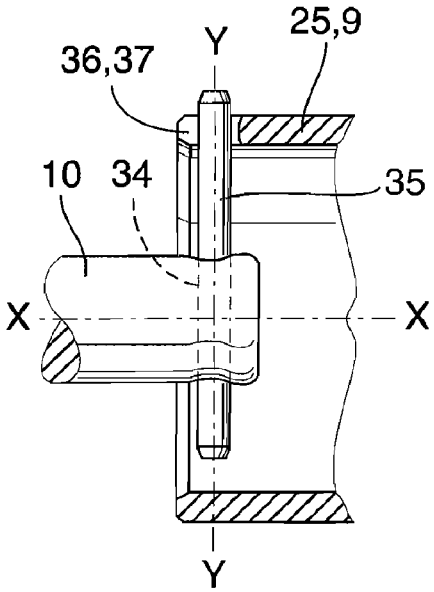
FIG. 10 a longitudinal cross-sectional view of another embodiment according to the invention of a coupling.
Figure 11:
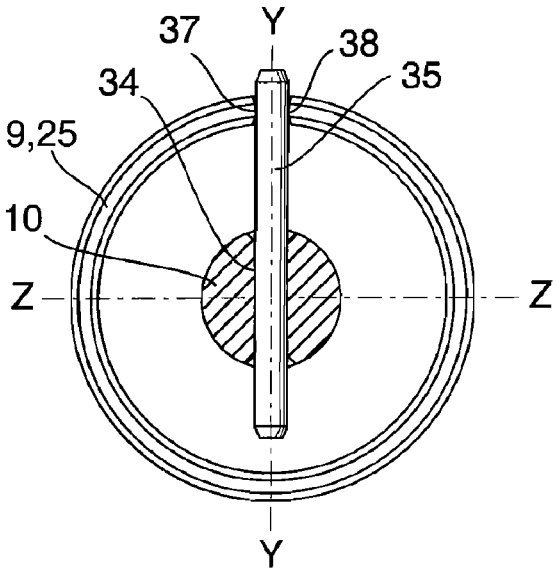
FIG. 11 a front view of the coupling according to FIG. 10.
Figure 12:
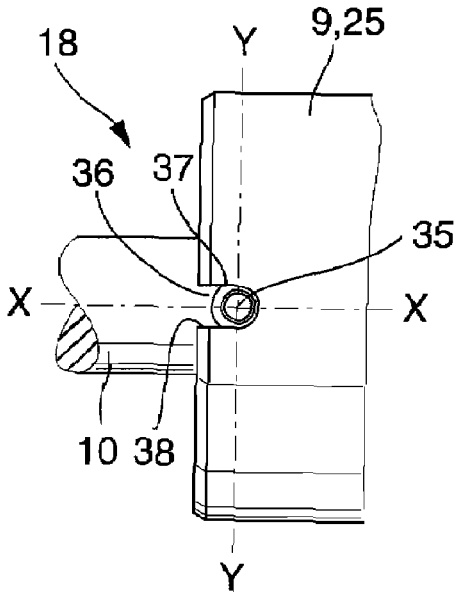
FIG. 12 a top view of the coupling according to FIGS. 10 and 11.

FIGS. 8 and 9 show the second coupling half constructed separate from the adjusting gear shaft 9.

An alternate embodiment of the invention is shown in FIGS. 10 to 14. The setting shaft 10 has accordingly a transverse bore 34, in which a pin 35 is held tightly, in the end region facing the adjusting gear shaft 9. In the end region facing the setting shaft 10, the adjusting gear shaft 9 is constructed as a hollow shaft and has a groove 36, which is open towards the outside and which is oriented parallel to the longitudinal axis X-X. The pin 35 passes radially through this groove and the pin 35 can move in this groove in the direction of the longitudinal axis X-X. The side surfaces 37, 38 of this groove contact the pin 35 without play in the circumferential direction. On the side facing away from the groove 36, the pin 35 projects only so far from the setting shaft 10 that the pin 35 does not come into contact with the adjusting gear shaft 9. The side surfaces 37, 38 of the groove 36 have a crowned or convex construction in the cross section shown in FIG. 11.

Figure 13:
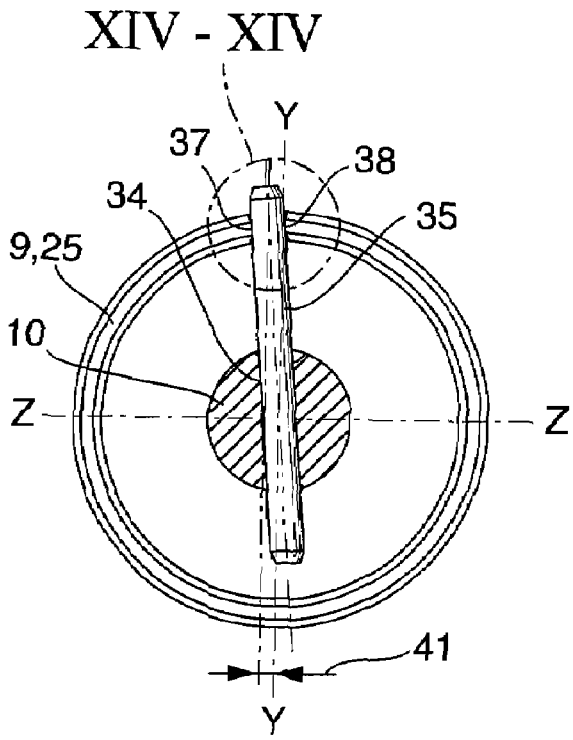
FIG. 13 a front view of the coupling according to FIGS. 10 to 12 for an eccentric arrangement of the setting shaft relative to the adjusting gear.
Figure 14:
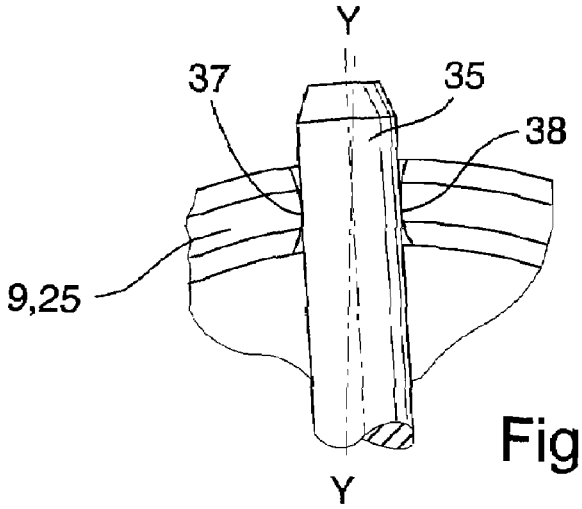
FIG. 14 an enlarged view of the detail XIV-XIV according to FIG. 13.

In FIGS. 13 and 14, the coupling 18 is shown for the case that the setting shaft 10 and adjusting gear shaft 9 have an eccentricity 41. Such an eccentricity 41 can be compensated for an unchanged position of the adjusting gear shaft 9 and slight rotation of the setting shaft 10, such that the pin 35 rolls on the crowned side surfaces 37, 38 of the groove 36, wherein the pin 35 is held without play between the side surfaces 37, 38 also during this rotating movement of the pin 35. Thus, the camshaft adjuster 1 can also operate for an eccentric assembly of the setting assembly 3 and adjusting gear 2. In the embodiment shown in FIG. 13, the eccentricity 41 is shown for the case that this is oriented perpendicular to the degree of shifting freedom, which is given by the crowned side surfaces 37, 38 for the pin 35. In this case, the eccentricity is compensated essentially through a rotation of the pin 35 relative to the second coupling half 25 (rolling motion on the crowned side surfaces 37, 38). In a different case, in which the eccentricity 41 is oriented in the direction of the previously named degree of shifting freedom, this can be compensated by a pure shift without rotation. For any orientation of the eccentricity deviating from these two special positions, the rotation and shifting are superimposed according to the degree of shifting freedom.

The first coupling half 19 preferably involves a steel part. Alternatively, other materials, such as, e.g., aluminum, brass, sintered steel, or the like, can also be used. The second coupling half 25 is preferably constructed with an elastomer composite part, which can be formed of a steel, aluminum, or brass carrier and a vulcanized elastomer, thermoplastic, or duroplastic that is pressed onto or into the adjusting gear shaft 9. Alternatively, however, it is also possible that the elastomer body is vulcanized directly onto the adjusting gear shaft 9 without an additional carrier part.

As an alternative to the shown embodiments, it is possible that the first coupling half 19 with the extension 21 is locked in rotation with the adjusting gear shaft 9, while the second coupling half 25 is locked in rotation with the setting shaft 10. Likewise, it is also conceivable that as an alternative or in addition to the elastic element allocated to the second coupling half 25, an elastic element is allocated to the extension 21.

Obviously, a combination of a radial extension 21 according to FIGS. 4, 6 with a groove 36 or a pin 35 with a Ω-shaped recess 39 is possible. The groove 36 and/or the pin 35 can also be provided in the region of a contact surface with an elastic element 30.

Naturally, it is also possible that the Ω-shaped recess 39 is constructed on the electric motor shaft and the pin 35 or the first coupling half 19 on the gear input side.

LIST OF REFERENCE SYMBOLS

1 Camshaft adjuster
2 Adjusting gear
3 Setting assembly
4 Two-cornered shaft coupling
5 Chain wheel
6 Closing wall
7 Tensioning screw
8 Camshaft
9 Adjusting gear shaft
10 Setting shaft
11 Spur gear
12 Spur gear
13 Internal teeth
14 Pin
15 Stator
16 Cylinder head
17 Permanent magnet rotor
18 Coupling
19 First coupling half
20 Bore
21 Radial extension
22 Base leg
23 Side leg
24 Side leg
25 Second coupling half
26 Metal body
27 Base leg
28 Side leg
29 Side leg
30 Elastic element
31 Contact surface
32 Contact surface
33 Internal contours
34 Transverse bore
35 Pin
36 Groove
37 Side surface
38 Side surface
39 Recess
40 Gap
41 Eccentricity

The invention claimed is:

1. A camshaft adjuster for adjusting a relative angular position of a camshaft relative to a crankshaft of an internal combustion engine comprising a setting shaft, which is driven by a setting assembly and which is in driving connection with an adjusting gear through a coupling, a transfer of a drive moment is performed by a radial extension of a first coupling half of the coupling, which contacts a second coupling half without play in a circumferential direction and which is movable in a radial direction relative to the second coupling half.

2. The camshaft adjuster according to claim 1, wherein the radial extension is pivotably supported for movement relative to the second coupling half parallel to a longitudinal axis of the second coupling half.

3. The camshaft adjuster according to claim 2, wherein at least one contact surface between the radial extension and the second coupling half has a crowned construction.

4. The camshaft adjuster according to claim 1, wherein the radial extension is constructed separate from the setting shaft and is connected to the setting shaft via a shaft-hub connection.

5. The camshaft adjuster according to claim 4, wherein the radial extension and the setting shaft are connected to each other via an interference fit, a non-positive-fit connection, or a positive-fit connection, or attachment means.

6. The camshaft adjuster according to claim 4, wherein the radial extension is produced without cutting.

7. The camshaft adjuster according to claim 1, wherein the radial extension is constructed separate from the setting shaft and is inserted into a recess of the setting shaft.

8. The camshaft adjuster according to claim 7, wherein the radial extension is constructed as a pin, which is inserted into the recess of the setting shaft.

9. The camshaft adjuster according to claim 1, wherein the radial extension is held in a radial recess of the second coupling half without play in the circumferential direction.

10. The camshaft adjuster according to claim 9, wherein the radial recess has approximately Ω-shaped inner contours in a cross section of the second coupling half.

11. The camshaft adjuster according to claim 9, wherein the recess is an axial groove in the second coupling half which is constructed as a hollow shaft.

12. The camshaft adjuster according to claim 1, wherein the first coupling half with the extension is movable axially relative to the second coupling half.

13. The camshaft adjuster according to claim 1, wherein forces flow between the radial extension and a second coupling surface via an element that is elastic in the circumferential direction.

14. The camshaft adjuster according to claim 13, wherein the elastic element is an elastomer, thermoplastic, or duroplastic, which is vulcanized onto one of the coupling halves.

15. The camshaft adjuster according to claim 1, wherein at least one of the first coupling half and second coupling half comprise a sheet-metal part.

16. The camshaft adjuster according to claim 1, wherein the first coupling half with the radial extension has a mass-balancing element for compensating an unbalanced mass due to the radial extension.

17. The camshaft adjuster according to claim 1, wherein the first coupling half is locked in rotation with the setting shaft.

* * * * *